US008016622B2

(12) United States Patent
Battle

(10) Patent No.: US 8,016,622 B2
(45) Date of Patent: Sep. 13, 2011

(54) MAINS-POWER ELECTRICAL CONNECTOR WITH A LIGHT PENETRABLE COVER

(75) Inventor: Robert James Battle, Yatala (AU)

(73) Assignee: Sicame Australia Pty Ltd (AU)

( * ) Notice: Subject to any disclaimer, the term of this patent is extended or adjusted under 35 U.S.C. 154(b) by 0 days.

(21) Appl. No.: 12/267,118

(22) Filed: Nov. 7, 2008

(65) Prior Publication Data

US 2010/0120300 A1 May 13, 2010

(51) Int. Cl.
*H01R 11/09* (2006.01)

(52) U.S. Cl. ..... 439/798; 439/279; 439/910; 439/718

(58) Field of Classification Search ..... 439/798, 439/709, 278, 279, 910, 718
See application file for complete search history.

(56) References Cited

U.S. PATENT DOCUMENTS

| | | | | |
|---|---|---|---|---|
| 6,688,921 | B2 * | 2/2004 | Borgstrom et al. | 439/798 |
| 6,764,354 | B2 * | 7/2004 | Kaine et al. | 439/793 |
| 6,854,996 | B2 * | 2/2005 | Yaworski et al. | 439/276 |
| 7,134,921 | B2 * | 11/2006 | Siracki et al. | 439/798 |
| 7,144,279 | B2 | 12/2006 | Zahnen et al. | |

* cited by examiner

*Primary Examiner* — Javaid Nasri
(74) *Attorney, Agent, or Firm* — Schubert Law Group PLLC; Jeffrey S Schubert

(57) ABSTRACT

The present invention relates to a mains-power electrical connector. The connector includes a core defining passages for receiving respective cables, and apertures for receiving fasteners to fasten the cables within the passages. Windows terminate the passages. A light penetrable cover is provided for covering the core and the windows. The fasteners may be in the form of shear bolts.

18 Claims, 6 Drawing Sheets

SECTION A-A

MAINS-POWER ELECTRICAL CONNECTOR WITH A LIGHT PENETRABLE COVER

TECHNICAL FIELD

The present invention relates to mains-power electrical connectors. The present invention has particular, although not exclusive application to mains-power electrical connectors used in underground power distribution systems.

BACKGROUND

The reference to any prior art in this specification is not, and should not be taken as an acknowledgement or any form of suggestion that the prior art forms part of the common general knowledge.

Mains-power electrical connectors are used for connecting two or more mains-power (e.g. 110V, 240V, 415V, etc.) electrical cables together. In underground power distribution systems, for example, lengths of insulated cable are serially connected together (i.e. daisy chained) using mains-power connectors which are located within protective "pillar" boxes, pits or handholes.

These connectors typically include a connector body. The connector body includes an electrically conductive core defining passages for receiving respective cables, and apertures for receiving fasteners to fasten the cables within the passages. The connector body further includes a protective insulator cover which covers the core. In use, a respective cable is located in each passage and the fasteners are engaged within the passages so as to clamp the cables therein and form an electrical connection between the cables via the core (and fasteners). The cables can be stripped of their insulation before fastening or, in some applications, the base of the fastener may include opposed piercing teeth for piercing the cable insulation.

In some circumstances, the cables are not fully inserted into the passages for fastening and therefore the cables may be undesirably prone to inadvertent removal from the passages or can become loose and thereby result in a bad electrical connection. In such circumstances, live cables may come loose from the connector which can result in equipment failure or even death.

U.S. Pat. No. 7,144,279 discloses a mains-power electrical connector with windows terminating respective passages, and an opaque thermoplastic elastomer (TPE) cover for covering the electrically conductive core and forming a molded water-tight bond with the periphery of the windows. In this manner, a user can discern the cables through the windows with a view of ensuring that the cables are fully inserted into the passages prior to fastening. In practice, the water tight bond between the windows and the cover is imperfect, and rain and moisture can trespass through the bond which undesirably results in internal corrosion of the connector and the cables.

SUMMARY OF THE INVENTION

According to one aspect of the present invention, there is provided a mains-power electrical connector including;

- a core defining passages for receiving respective cables, and apertures for receiving fasteners to fasten the cables within the passages;
- one or more windows for terminating the passages; and
- a light penetrable cover for covering the core and the windows.

Moisture is impeded from entering the connector about the windows, as the cover covers the windows.

Preferably, said light penetrable cover is translucent and the windows are transparent. Advantageously, the translucent cover manifests the discernable contrast between a fully and partially inserted cable whereby the cable is only visible when in close proximity to the cover. The light penetrable cover may be homogenous and molded from a Styrene-Ethylene/Butylene-Styrene (SEBS) polymer. Preferably, the cover is an electrical insulator integrally formed from resilient material. The cover may define a first set of inlet stems for receiving the fasteners and a second set of inlet stems for receiving the cables.

Each inlet stem may define outer retention ribs. The second set of inlet stems may include inner sealing ribs to form a watertight seal around larger cables. The connector may further include tubular endcaps for engaging with respective inlet stems of the second set to form a water tight seal. Each endcap may define internal retention ribs to impede its removal from the inlet stem. Each endcap may also define internal ribs to form a watertight seal around smaller cables. Each fastener may engage with an inlet stem of said first set to form a water tight seal.

Each window may include a generally curved portion that protrudes outwardly from its passage. The curved portion provides structural stability to impede shattering of the window when the cover is applied to cover the core and windows. Each window may include a skirt depending from the curved portion and configured to be force fitted within its passage. The windows may be homogenous and molded from polycarbonate materials.

The core may include extruded electrically conductive aluminum. Each aperture may be threaded to complementarily engage with a threaded shaft of the fastener. A pair of apertures may extend from each passage. The core may define a plurality of passages which are parallel.

The connector may further include teeth assemblies for force fitting into respective passages.

The window and cover may be selected from materials so that no bond forms between them.

The mains-power electrical connector may further include the fasteners. Each fastener may have a head from which a threaded shaft extends, the head defining a recess such that a tip of the head can be separated from the fastener by shearing as the fastener is tightened within the core to fasten one of the cables. The recess may be inwardly tapered. The recess may continuously extend around the head.

The head may define a pair of polygonal portions on opposite sides of the recess. The separation of opposite flats of the endmost polygonal portion may be greater than the separation of opposite flats of the other polygonal portion. Advantageously, a tightening tool can engage with the flats of the endmost polygonal portion and tighten the fastener without being able to engage with the flats of the other polygonal portion. Each polygonal portion may be hexagonal.

The head may define a cap extending from the polygonal portions. The cap may define a recess in which an inlet stem of the cover is clamped. The cap may include a resilient outer skirt which clamps against the inlet stem. The cap may define a flat roof surface against which the tightening tool can be pressed during tightening of the fastener. The recess may be endless. The shaft may define a ribbed tip which can be force fitted into a cavity of the cap. The shaft may further define a ledge separating the ribbed tip from a threaded portion.

The head may be integrally formed from nylon, steel, brass, copper, plastic or aluminium material.

According to one aspect of the present invention, there is provided a method for manufacturing a mains-power electrical connector, the connector including a core defining passages for receiving respective cables and apertures for receiving fasteners to fasten the cables within the passages, the method including the steps of:

terminating the passages with one or more windows; and covering the core and the windows with a light penetrable cover.

According to another aspect of the present invention, there is provided a mains-power electrical connector including:

a core for receiving cables; and a homogeneous cover for covering the core and through which the cables within the core can be discerned.

The mains-power electrical connector may further include one or more windows beneath the cover through which the cables within the core can be discerned.

According to another aspect of the present invention, there is provided a shear fastener for a mains-power electrical connector, the fastener including a head from which a threaded shaft extends, the head defining a pair of polygonal portions separated by a recess so that an endmost one of the polygonal portions can be separated from the fastener by shearing as the fastener is tightened within the connector, separation of opposite flats of the endmost polygonal portion being greater than separation of opposite flats of the other polygonal portion.

According to another aspect of the present invention, there is provided a shear fastener for a mains-power electrical connector, the fastener including a head from which a threaded shaft extends, the head defining a pair of polygonal portions separated by a recess so that an endmost one of the polygonal portions can be separated from the fastener by shearing as the fastener is tightened within the connector, separation of opposite corners of the endmost polygonal portion being greater than separation of opposite corners of the other polygonal portion.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
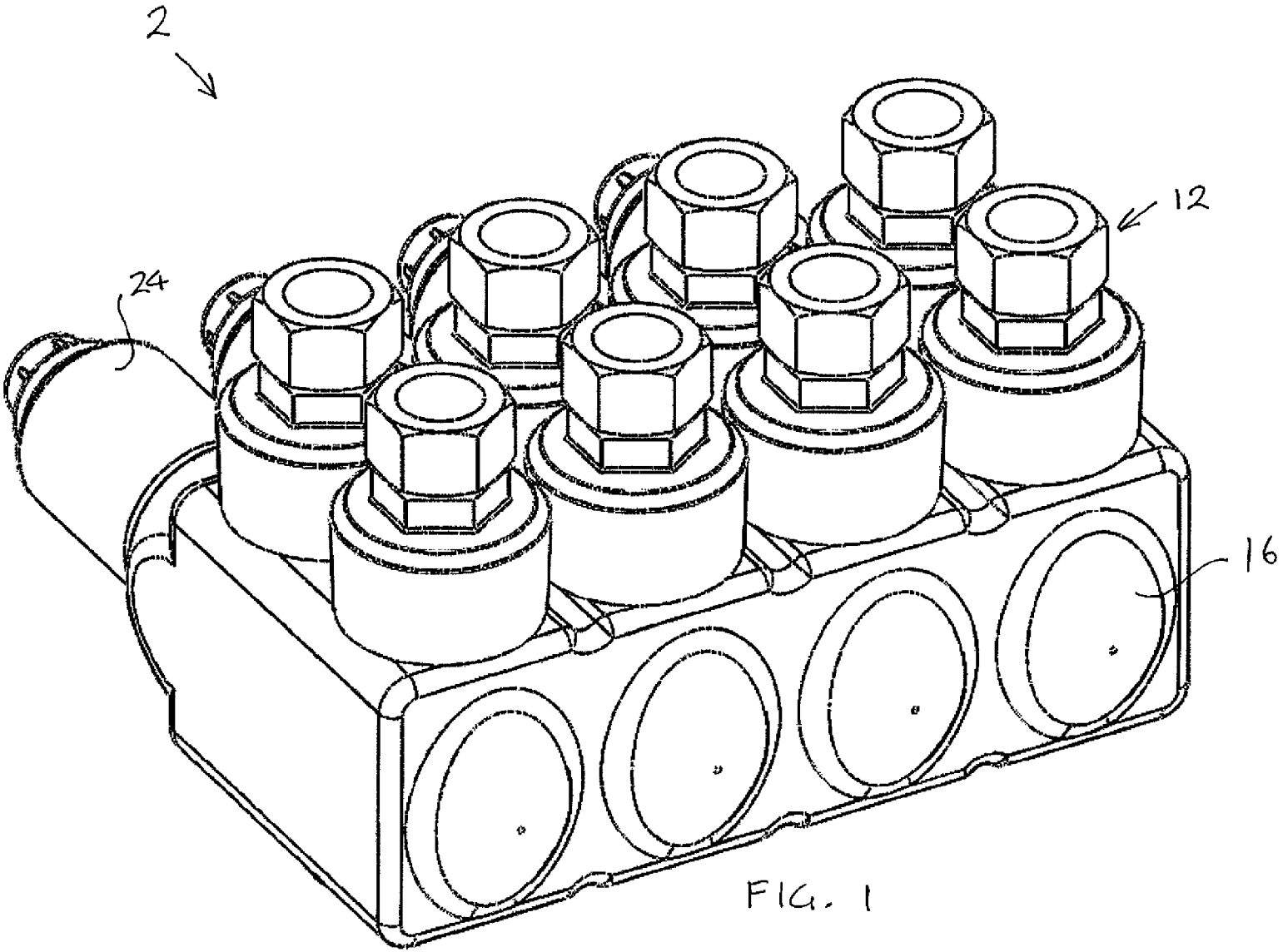
FIG. 1 is an upper rear perspective view of a mains-power electrical connector in accordance with an embodiment of the present invention.
Figure 2:
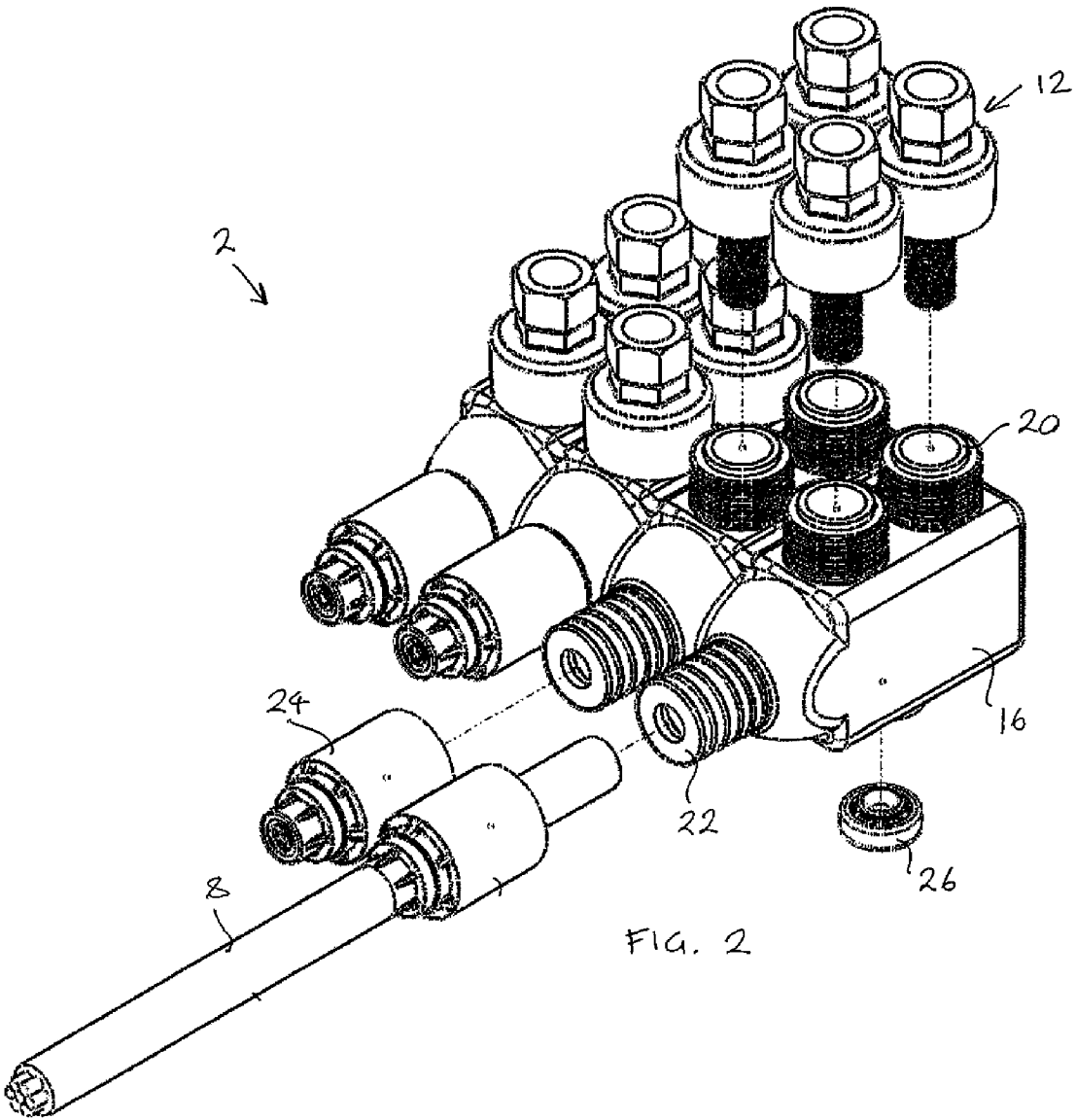
FIG. 2 is an upper front partially exploded perspective view of the mains-power electrical connector of FIG. 1.
Figure 3:
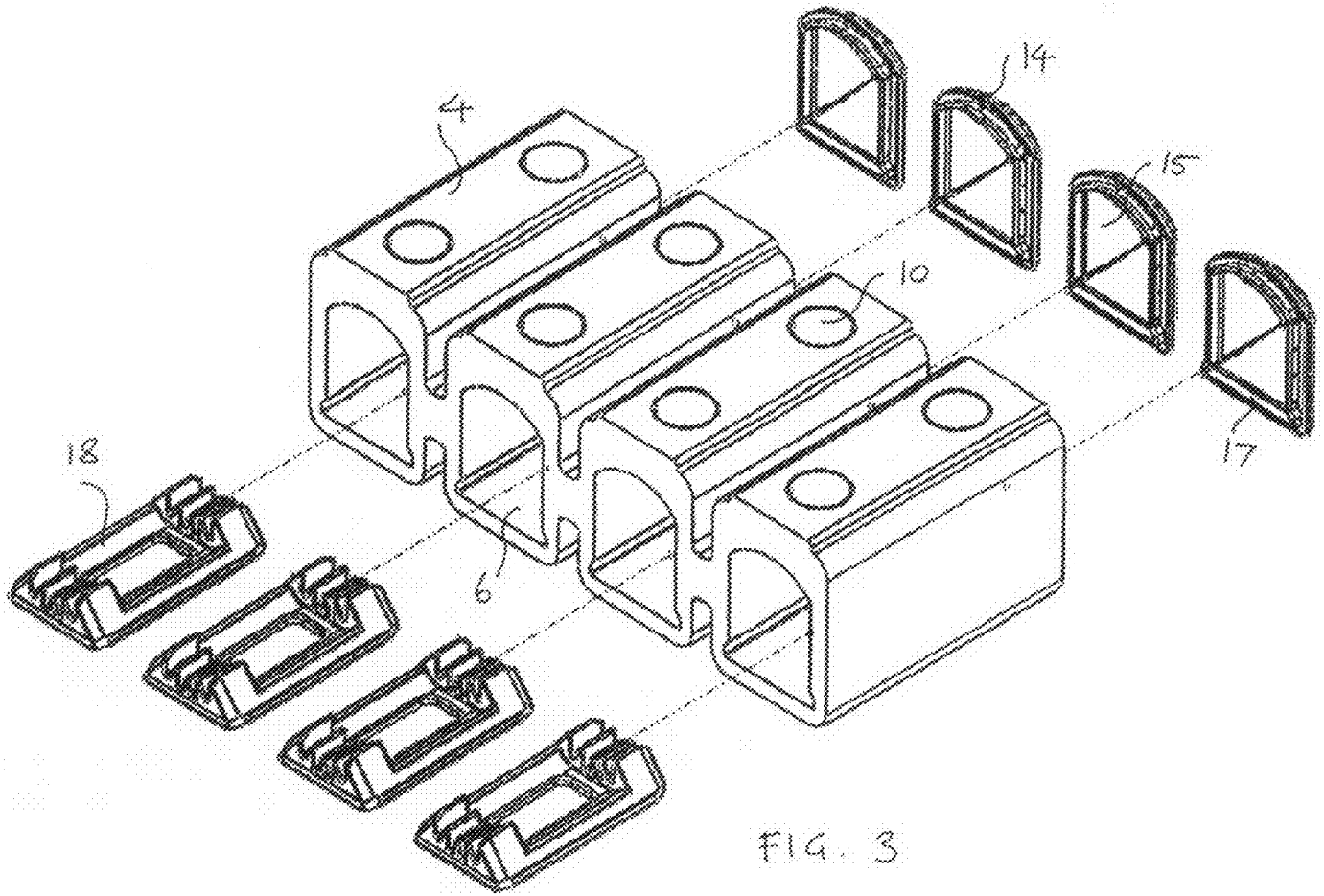
FIG. 3 is an upper front partially exploded perspective view of a core of the mains-power electrical connector of FIG. 1.

According to an embodiment of the present invention, there is provided a mains-power electrical connector 2 as shown in FIGS. 1 and 2. Turning briefly to FIG. 3, the connector 2 includes an electrically conductive core 4 defining passages 6 for receiving respective multi-strand cables 8, and apertures 10 for receiving fasteners 12 to fasten the cables 8 within the passages 6. Transparent windows 14 terminate the passages 6. Turning to FIG. 1, a light-penetrable cover 16 covers the core 4 and the windows 14, and a user can discern the cable ends within the core 4 through the cover 16 when fastening the cables 8 within the passages 6. Moisture is impeded from entering the connector 2 about the windows 14, as the cover 16 wholly covers the windows 14 and there is no joining seam there-between. The connector 2 is described in detail below.

Returning to FIG. 3, the electrically conductive core 4 includes extruded aluminum and defines a quartet of parallel passages 6. A pair of fastener apertures 10 extends from each passage 6. Each fastener aperture 10 is threaded to complementarily engage with a threaded shaft of a fastener 12.

The connector 2 further includes a quartet of teeth assemblies 18 for force fitting into respective passages 6. Each teeth assembly 18 is formed from tinned high pressure cast brass and is electrically conductive. Each teeth assembly 18 rests on the floor of its passage 6. In use, the fastener 12 presses the cable 8 against the teeth assembly 18 which, in turn, pierces the cable insulation and forms an electrical connection between the cable 8 and the core 4 via the teeth assembly 18. Alternatively, the cable end may be stripped of its insulation before being inserted into the passage 6 and the teeth assembly 18 bites the cable 8 to impede its removal.

Each clear window panel 14 includes a generally curved viewing portion 15 that protrudes outwardly beneath the cover 16 from its passage 6 as can best be seen in FIG. 1. The curved viewing portion 15 provides structural stability to impede shattering of the window 14 when the cover 16 is applied to cover the core 4 and windows 14. Each window 14 also includes an endless skirt 17 depending from the curved viewing portion 15. The skirt 17 is configured to be force fitted within its passage 6.

The light penetrable cover 16 is integrally molded from translucent Styrene-Ethylene/Butylene-Styrene (SEBS) polymer and is homogeneous. Advantageously, the translucent cover 16 manifests the discernable contrast between a fully and partially inserted cable 8 whereby the cable 8 is only visible when in close proximity to the cover 16. Accordingly, the cable 8 is only clearly discernable when fully inserted into the passage 6 which signals the user to only then fasten the cable 8 within the passage 6 with the fasteners 12.

The cover 16 is an electrical insulator integrally formed from elastically resilient material. Turning to FIG. 2, the cover 16 defines a top set of inlet stems 20 for receiving the fasteners 12 and a side set of inlet stems 22 for receiving the cables 8. Each inlet stem 20, 22 is tubular and defines outer retention ribs. The outer retention ribs of the top inlet stems 20 impede removal of the fasteners 12 whereas the outer retention ribs of the side inlet stems 22 impede removal of tubular endcaps 24 force fitted thereon.

The cables 8 pass through the resilient endcaps 24 and into the passages 6. The side set of inlet stems 22 define inner ribs to form a watertight seal around larger cables 8. Each endcap 24 also defines internal retention ribs to impede removal of the endcap 24 from the inlet stem 22. The tubular endcaps 24 engage with respective side inlet stems 22 to form a water tight seal. The tubular endcaps 24 also form a water tight seal with the cables 8 passing there-through.

During molding of the cover 6 over the core 4 and windows 14, base holders (not shown) can be used to hold the core 4 in a fixed position within the mold. As can best be seen in FIG.

2, one or more plugs 26 may be required to plug holes formed in the cover 16 and in which the holders were situated during molding.

Figure 4B:
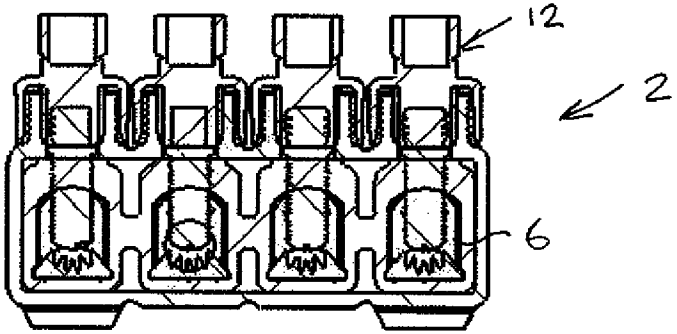
FIG. 4*b* is a front view of the mains-power electrical connector of FIG. 4*a* sectioned through the line A-A.
Figure 5:
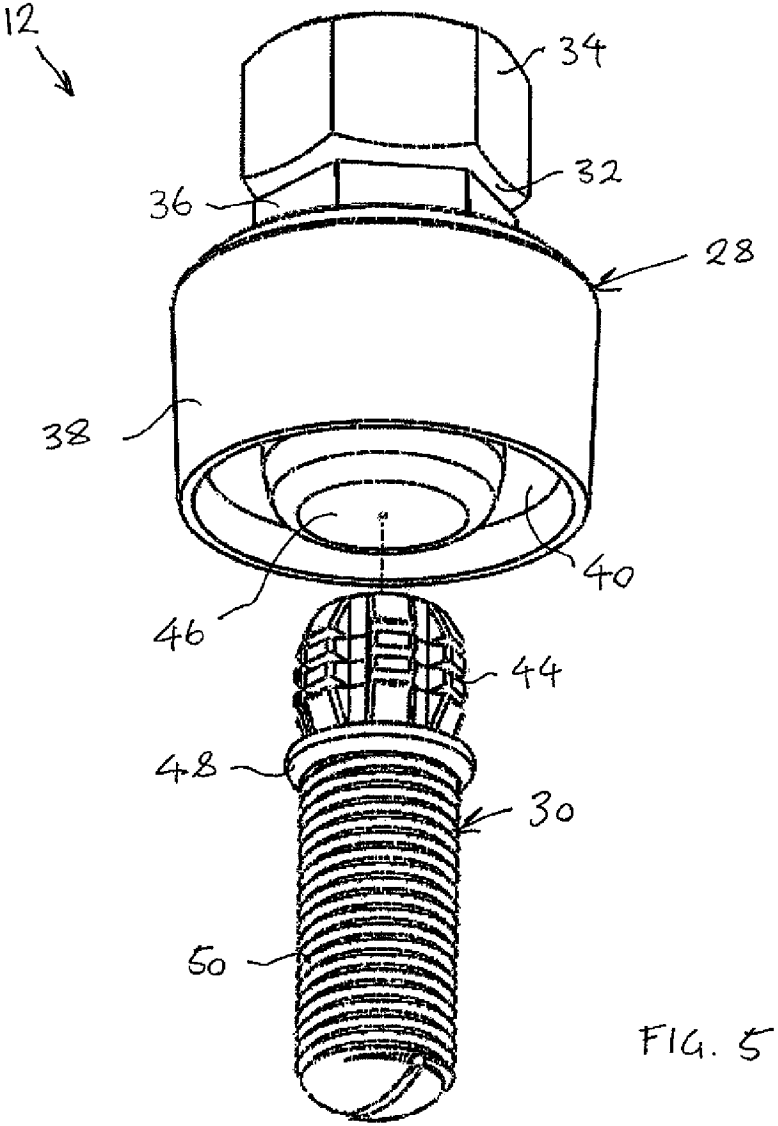
FIG. 5 is an exploded lower perspective view of a fastener of the mains-power electrical connector of FIG. 1.
Figure 6:
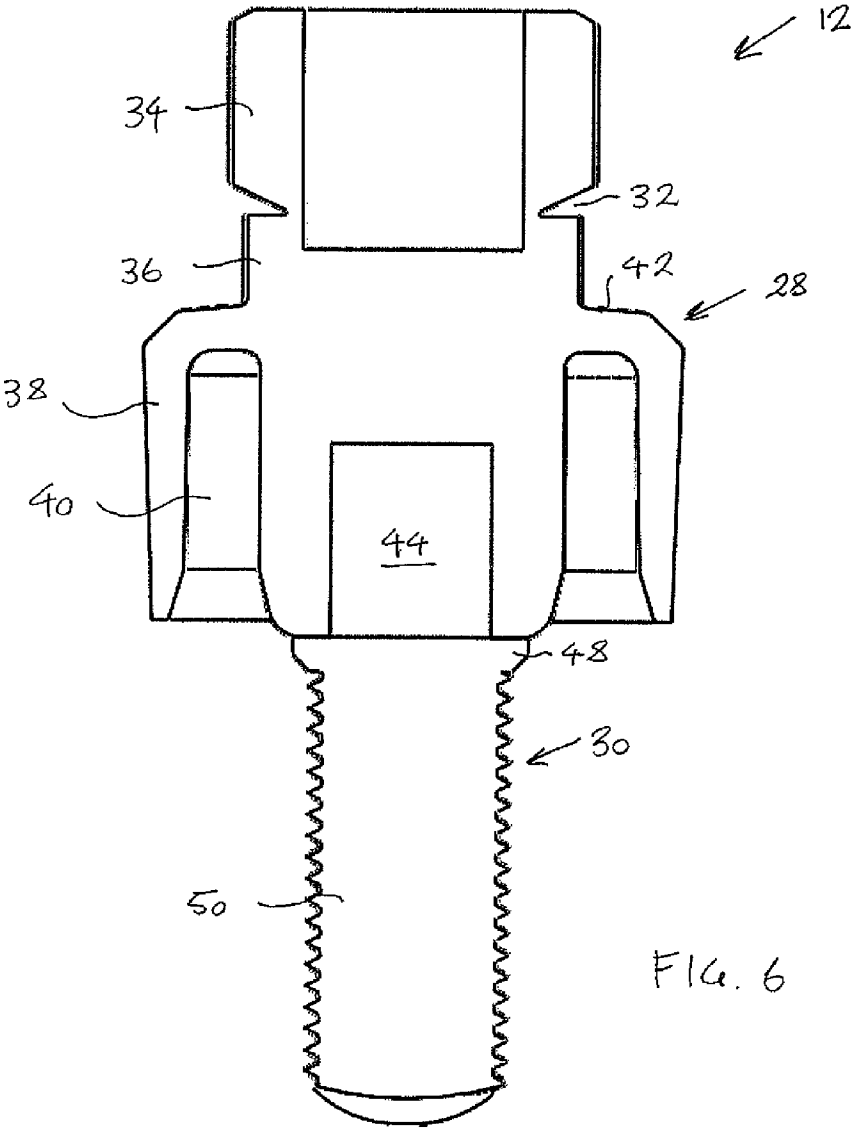
FIG. 6 is a side sectioned view of the fastener of FIG. 5.

Turning to FIG. 4, the mains-power electrical connector 2 includes eight fasteners 12, with two fasteners 12 to engage with the cable 8 in each passage 6. Turning to FIG. 5, each fastener 12 is a shear bolt and has a plastic head 28 from which a threaded shaft extends 30. The head 28 defines a recess 32 such that a hexagonal tip 34 of the head 28 can be separated from the fastener 12 by shearing as the fastener 12 is tightened within the connector 2 to fasten one of the cables 8. As can best be seen in FIG. 6, the recess 32 is inwardly tapered and continuously extends around the head 28.

The head 28 defines a pair of hexagonal portions 34, 36 an opposite sides of the recess 32. The separation of opposite flats of the endmost hexagonal portion 34 is greater than the separation of opposite flats of the other hexagonal portion 36. The flats of each hexagonal portion 34, 36 are the six flat edges with which a tightening tool can engage. It follows that separation of opposite corners of the endmost hexagonal portion 34 is greater than separation of opposite corners of the other hexagonal portion 36. Advantageously, the tightening tool (e.g. pneumatic wrench) can engage with the flats of the endmost hexagonal portion 34 and tighten the fastener 12 without being able to engage with the flats of the other hexagonal portion 36.

The head 28 also defines a cap 38 extending downwardly from the hexagonal portions 34, 36. The cap 38 defines an endless recess 40 in which a top inlet stem 20 of the cover 16 is clamped to form a water tight seal. The cap 38 includes an elastically resilient outer skirt which clamps against the stem 20. The cap 38 defines a flat roof surface 42 against which the tightening tool can be pressed during tightening of the fastener 12.

As can best be seen in FIG. 5, the threaded shaft 30 defines a ribbed tip 44 which can be force fitted into a cavity 46 defined in a central hub of the cap 38. The shaft 30 also defines a protruding ledge 48 separating the ribbed tip 44 from a threaded tail 50.

The manufacture and subsequent assembly of the connector 2 will now be briefly described.

Initially, the teeth assemblies 18 and windows 14 are force fitted into respective passages 6 of the core 4 as shown in FIG. 3. The passages 6 are terminated with respective windows 14 and the teeth assemblies 18 are wholly located within the passages 6.

Next, core 4 is placed within a mold. The cover 16 is molded over the core 4 and windows 14 so that the windows 16 are wholly located beneath the molded cover 16. The windows 14 and cover 16 are selected from materials so that no adhesive bond forms between them. The cover is molded at a carefully controlled temperature and pressure, each adjusted so that there is no breaking or melting of the window 14 during injection yet high enough to ensure complete molding of the cover 16. The actual values of temperature and pressure will be dependant on the size and type of moulding machine.

The Styrene-Ethylene/Butylene-Styrene (SEBS) polymer cover material also provides a suitable degree of transparency so that the cables can be discerned within the passages 6.

The core is removed from the mold and the plugs 26 are inserted to plug holes formed in the cover 16 during molding.

Figure 4A:
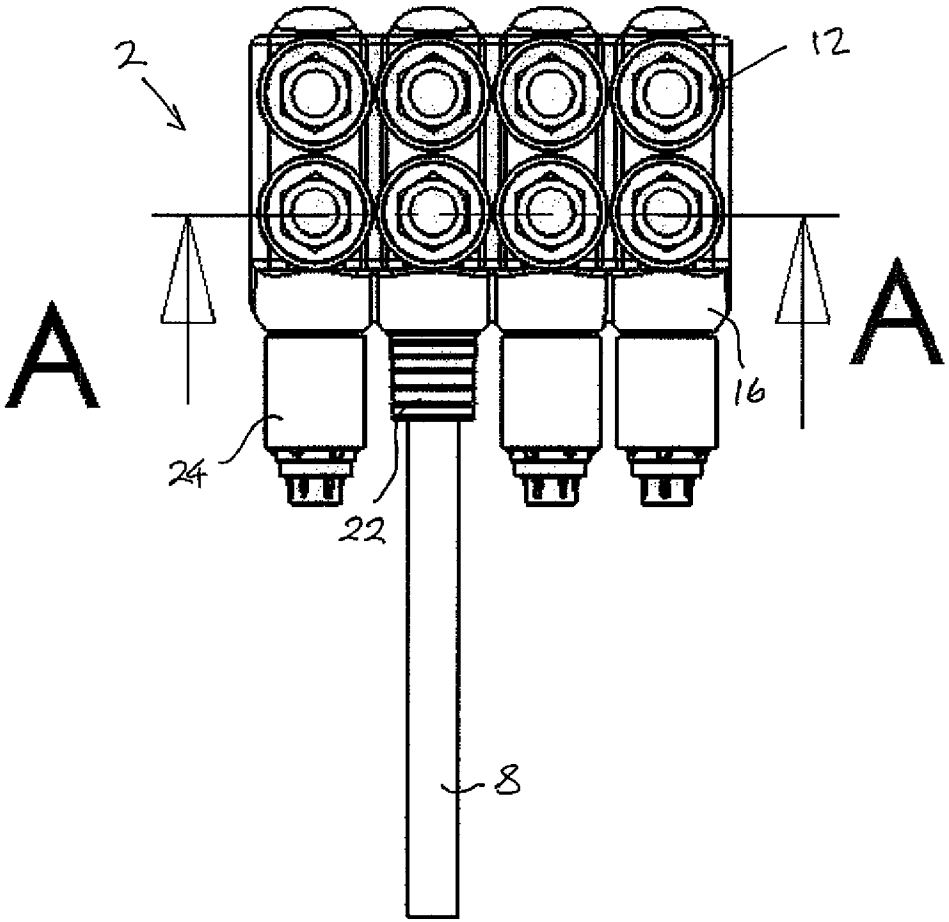
FIG. 4*a* is a plan view of the mains-power electrical connector of FIG. 1.

The cables 8 are inserted either through respective endcaps 24 as shown in FIG. 2, or directly through the side inlet stem 22 as shown in FIG. 4*a*. The endcaps 24 are then pushed onto the side stems 22 to form a water tight seal. The cables 8 are pushed into the passages 6 until they abut the windows 14 and a user can discern them through the cover 16.

The fasteners 12 are then tightened within the core 4. The tightening tool engages with opposite flats of the endmost hexagonal portion 34 and screws the threaded shaft 50 into the threaded aperture 10. The shaft 50 pushes the cable 8 within the passage 6 against the teeth assembly 18 and thereby secures the cable 8. During tightening, the cap 38 is twisted onto the top stem 20 and forms a water tight seal. Accordingly, the corrosive components within the connector 2 are sealed within the water tight connector 2.

When each fastener 12 is tightened to a required extent, the endmost hexagonal portion 34 shears and separates from the fastener 12. In order to un-tighten the fastener at a later stage, an un-tightening tool having a narrower gauge bit can be used to engage with opposite flats of the other hexagonal portion 36.

A person skilled in the art will appreciate that many embodiments and variations can be made without departing from the ambit of the present invention.

In the preferred embodiment, a plurality of windows 14 terminated respective passages 6 defined within the core 4. In an alternative embodiment, the windows may be integrally formed together to form a single unit.

In the preferred embodiment, the fastener head 28 was molded from plastic material. Alternatively, the head 28 may be integrally formed from nylon, steel, brass, copper, or aluminium material.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The claims defining the invention are as follows:

1. A mains-power electrical connector including:

a core defining passages for receiving respective cables, and apertures for receiving fasteners to fasten the cables within the passages;

one or more window panels for terminating the passages; and a light penetrable cover for covering the core and the window panels;

wherein the cover is molded over the core and window panels so that the window panels are wholly located beneath the cover.

2. A connector as claimed in claim 1, wherein said light penetrable cover is translucent and the window panels are transparent.

3. A connector as claimed in claim 1, wherein the cover defines a first set of inlet stems for receiving the fasteners and a second set of inlet stems for receiving the cables.

4. A connector as claimed in claim 3, further including tubular endcaps for engaging outside respective inlet stems of the second set to form a water tight seal.

5. A connector as claimed in claim 3, wherein each fastener engages with an inlet stem of said first set to form a water tight seal.

6. A connector as claimed in claim 1, wherein each window panel includes a generally curved portion that protrudes outwardly from its passage, and a skirt depending from the curved portion which can be received within its passage.

7. A connector as claimed in claim 1, wherein each aperture is threaded to complementarily engage with a threaded shaft of the fastener.

8. A connector as claimed in claim 1, further including teeth assemblies within respective passages.

9. A connector as claimed in claim 1, further including the fasteners with each fastener having a head from which a threaded shaft extends, the head defining a recess such that a tip of the head can be separated from the fastener by shearing as the fastener is tightened within the core to fasten one of the cables.

10. A connector as claimed in claim 9, wherein the head defines a pair of polygonal portions on opposite sides of the recess, a separation of opposite flats of the endmost polygonal portion being greater than a separation of opposite flats of the other polygonal portion.

11. A connector as claimed in claim 10, wherein the head defines a cap extending from the polygonal portions, the cap defining a recess in which an inlet stem of the cover is clamped to form a water tight seal.

12. A method for manufacturing a mains-power electrical connector, the connector including a core defining passages for receiving respective cables and apertures for receiving fasteners to fasten the cables within the passages, the method including the steps of:

terminating the passages with one or more window panels; and molding a light penetrable cover over the core and the window panels so that the window panels are wholly located beneath the cover.

13. A mains-power electrical connector including:

a core for receiving cables;

a homogeneous cover for covering the core and through which the cables within the core can be discerned; and one or more window panels beneath the cover through which the cables within the core can be discerned;

wherein the cover is molded over the core and window panels so that the window panels are wholly located beneath the cover.

14. A connector as claimed in claim 13, wherein the core defines passages for receiving respective cables and apertures for receiving fasteners to fasten the cables within the passages, the window panels terminating respective passages.

15. A connector as claimed in claim 14, further including the fasteners with each fastener having a head from which a threaded shaft extends, the head defining a recess such that a tip of the head can be separated from the fastener by shearing as the fastener is tightened within the core to fasten one of the cables.

16. A connector as claimed in claim 15, wherein the head defines a pair of polygonal portions on opposite sides of the recess, a separation of opposite flats of the endmost polygonal portion being greater than a separation of opposite flats of the other polygonal portion.

17. A connector as claimed in claim 14, wherein each window panel includes a generally curved portion that protrudes outwardly from its passage, and a skirt depending from the curved portion which can be received within its passage.

18. A connector as claimed in claim 13, wherein the cover engages with other connector parts so that the assembled connector is water tight.

* * * * *